US007299850B2

(12) United States Patent
Miller

(10) Patent No.: US 7,299,850 B2
(45) Date of Patent: Nov. 27, 2007

(54) QUICK RELEASE ROLLER SHUTTER

(75) Inventor: James V. Miller, Glen Ellyn, IL (US)

(73) Assignee: Qualitas Manufacturing, Inc., Itasca, IL (US)

( * ) Notice: Subject to any disclaimer, the term of this patent is extended or adjusted under 35 U.S.C. 154(b) by 220 days.

(21) Appl. No.: 11/005,744

(22) Filed: Dec. 7, 2004

(65) Prior Publication Data

US 2006/0118251 A1 Jun. 8, 2006

(51) Int. Cl.
*E06B 9/08* (2006.01)
*B65H 75/48* (2006.01)

(52) U.S. Cl. ..... 160/133; 242/375.1

(58) Field of Classification Search ..... 160/133, 160/193, 319, 298, 307, 308; 242/375.1, 242/379.2, 381.1
See application file for complete search history.

(56) References Cited

U.S. PATENT DOCUMENTS

| | | | | | |
|---|---|---|---|---|---|
| 3,970,134 | A | | 7/1976 | Sinnock et al. | |
| 4,016,920 | A | * | 4/1977 | Shepard | 160/133 |
| 4,534,396 | A | * | 8/1985 | Jung | 160/298 |
| 4,883,109 | A | * | 11/1989 | Sonderby | 160/32 |
| 5,437,324 | A | * | 8/1995 | Sternquist | 160/299 |
| 5,573,050 | A | * | 11/1996 | Henkenjohann | 160/133 |
| 5,938,136 | A | * | 8/1999 | Miller | 242/375.1 |
| 5,975,185 | A | | 11/1999 | Miller et al. | |
| 5,996,669 | A | | 12/1999 | Miller | |
| 6,095,225 | A | | 8/2000 | Miller | |
| 6,244,325 | B1 | * | 6/2001 | Miller et al. | 160/310 |
| 6,302,179 | B1 | * | 10/2001 | Miller | 160/23.1 |
| 6,453,972 | B1 | * | 9/2002 | Sher et al. | 160/133 |
| 6,631,749 | B1 | * | 10/2003 | Zabala | 160/133 |
| 7,076,917 | B2 | * | 7/2006 | Chang | 49/139 |

OTHER PUBLICATIONS

QMI Standard Control Details, http://www.qmisecuritysolutions.com/technical/moreinfo/standard.html, undated.
QMI Controls Safety First, http://www/securityshutters.com/index.html, undated.

* cited by examiner

*Primary Examiner*—David M. Purol
*Assistant Examiner*—Candace L. Bradford
(74) *Attorney, Agent, or Firm*—Ice Miller LLP

(57) ABSTRACT

The present invention is directed to a roll-up partition comprising a rolling shutter, a shutter assembly, a flexible strap and a tensioner. The tensioner includes a locking mechanism that is configured to lock and unlock the flexible strap and a quick release mechanism configured to release the locking mechansim, thus allowing the rolling shutter to change positions. The invention also includes a strap recoiler with a locking mechanism and a quick release mechanism, wherein activation of the quick release mechanism causes the release of the locking mechanism, thus allowing the roll-up partition to change positions. The invention also includes a method of exiting an enclosed space partially bounded by a portal protected by a roller shutter. The method includes operating the quick release mechanism, waiting for the shutter to retract and exiting the space through the portal.

24 Claims, 10 Drawing Sheets

QUICK RELEASE ROLLER SHUTTER

FIELD OF THE INVENTION

The present invention is directed to a roll-up partition system assembly having a protective partition for covering a window or door opening that may be rolled up into a housing when not in use. More particularly, the present invention is directed to an assembly implementing a strap box and having an emergency opening mechanism.

BACKGROUND OF THE INVENTION

Roll-up partition systems protect portals such as windows and doors from break-ins or from wind gusts and flying debris in heavy storms. One type of roll-up partition system is a rolling protective shutter. Rolling protective shutters are conventional and are used to provide protection against extreme weather conditions and to deter theft, for example. Rolling shutters illustratively comprise a plurality of elongate slats that are interconnected by a plurality of hinges. When not in use, the shutter may be retracted into a casing that is usually situated either above or beside the portal, illustratively a window or door. Retracting involves rolling up the shutter onto a roller tube. The shutter is composed of a number of elongated slats that are articulated along their long edges. Forming the shutter out of articulated slats enables the shutter to be retracted compactly yet be strong enough to deter burglary and provide protection against flying debris.

Roll-up partitions in general, and rolling protective shutters in particular, sometimes incorporate one or more torsion spring assemblies to assist in rolling and unrolling the shutters manually or by a powered opening device. In one illustrative arrangement, the assembly is a self-contained modular unit having a spring shaft surrounded by a coiled torsion spring. One end of the spring shaft includes a spring shaft support that is rotatable about the spring shaft, and a spring plate rigidly fixed to the spring shaft and to the proximate end of the torsion spring to prevent rotation of the end of the torsion spring relative to the spring shaft. The other end of the spring shaft includes a spring drive that is rotatable about the spring shaft and rigidly fixed to the other end of the torsion spring. The assembly is inserted into the shutter support member with one end of the spring shaft rigidly fixed to the shutter housing. The spring shaft support and spring drive engage the interior of and rotate with the shutter support member. When the shutter is unrolled, the torsion spring is wound tighter, thereby providing for controlled deployment and providing additional torque to assist in lifting and rolling the shutter onto the shutter support member. During normal operation of the rolling protective shutters, the torsion spring exerts a minimum torque when the shutter is in the rolled position and a maximum torque when the shutter is in the unrolled position.

Taking as an example a shutter for a window opening with a casing located above the window, as the shutter is unrolled the weight of the deployed portion of the shutter tends to cause unrolling to accelerate uncontrollably. To prevent such uncontrolled deployment, with the accompanying noise and potential for injury, the torsion spring biases the roller tube toward the fully retracted position. Rotation of the roller tube about the spring shaft in the direction for deployment tightens the torsion spring, which resists further motion in the direction of rotation, thereby at least partially compensating for the accelerating effect of the ever increasing weight of the unrolled portion of the shutter as it is being deployed. When the roller tube is rotated in the opposite direction to retract the shutter, the bias force of the torsion spring assists the motive force to lift the shutter, and the assistance diminishes as rolling of the shutter onto the roller tube progresses. The degree of bias is determined by the choice of spring and/or any pretensioning there may be when the shutter is fully retracted. The degree of bias, in turn, determines whether a shutter of a predetermined weight will remain deployed or will retract when there is no braking force on the roller tube to prevent rotation. For safety reasons, roller shutters may be equipped with a sufficiently strong torsion spring to fully retract the shutter when there is no braking force applied to the roller tube.

The motive force behind retraction and deployment of the shutter may be provided manually, e.g. by an operator pulling a strap, or electro-mechanically, e.g. by a motor.

Some building code regulations require that manual and electro-mechanical shutters be able to be opened very quickly in the case of an emergency, such as during a fire. A safety mechanism enabling quick release of a roller tube that is engaged to an electric motor is discussed in commonly-assigned U.S. Pat. Nos. 5,975,185 and 6,244,325, the teachings of which are herein incorporated by reference.

In manually operated shutters employing a strap, there is typically a pulley at one end of the roller tube. Illustratively, the pulley is attached to the shutter support member, and the strap is connected between the pulley and a strap recoiler (or "strap box" mounted to one of the shutter tracks or to the wall surrounding the opening. The strap recoiler includes a take-up roll upon which the excess strap is stored and a locking mechanism with a brake tab that locks the strap in place when the strap is pulled tight between the pulley and the strap recoiler. The locking mechanism of the strap recoiler is configured to facilitate retraction and deployment of the strap to roll and unroll the shutter. Illustratively, to roll the shutter to the retracted position, the strap is pulled outwardly away from the shutter track and opening and pulled downwardly toward the strap recoiler. As the strap is pulled outwardly, the locking mechanism releases the strap and allows the force of a torsion spring within the take-up roll to wind the excess strap onto the take-up roll. At the same time, the control strap is unrolled from the pulley, thereby rolling the shutter onto the shutter support member. When the strap is released, the weight of the shutter rotates the pulley and pulls the strap tight between the pulley and the strap recoiler, thereby locking the locking mechanism. To unroll the shutter to the deployed position, the strap is pulled outwardly away from the shutter track and opening and pulled upwardly toward the pulley and shutter housing. As the strap is pulled outwardly, the locking mechanism releases the strap and allows the strap to unwind from the take-up roll. At the same time, the control strap is rolled onto the pulley as the shutter support member rotates due to the weight of the shutter. When the strap is released, the weight of the shutter and the tension in the torsion spring pull the strap tight between the pulley and the strap recoiler, thereby locking the locking mechanism.

To improve the safety of manually operated roller shutters for doors and windows and to meet regulatory objectives, it would be highly desirable to have a quick release mechanism for a manually operated roller shutter employing a strap recoiler.

SUMMARY OF THE INVENTION

The present invention provides a roller shutter having a quick release feature that the roller shutter to move to a desired position.

One embodiment of the present invention is a roll-up partition comprising:

a) a shutter assembly comprising:

i) a shutter assembly housing adapted to be mounted to a wall above or beside a portal, ii) a roller tube rotatably mounted in the shutter assembly housing, and iii) a rolling shutter connected to the roller tube and configured to move between a retracted position in which the rolling shutter is wrapped around the roller tube and an open position in which the rolling shutter is deployed within the portal, b) a flexible strap having a proximal end and a distal end, the proximal end connected to the roller tube, c) a tensioner external to the shutter assembly housing, the tensioner connected to the distal end of the flexible strap and comprising a locking mechanism configured to releasably lock the flexible strap in place and a quick release mechanism configured to release the locking mechanism upon activation of the quick release mechanism, to allow the rolling shutter to change positions.

Illustratively, the locking mechanism is a brake tab, and the quick release mechanism changes the angle between the strap and the brake tab or otherwise releases the brake tab from a bearing surface. In various embodiments, the quick release mechanism is a pin, the removal of which permits the tensioner to pivot toward the roller tube, thereby releasing the locking mechanism. In other embodiments, the quick release mechanism is a lever or knob operatively connected to the locking mechanism, the movement of which releases the locking mechanism.

In illustrative embodiments, the roll-up partition further comprises a torsion spring connected to the roller tube, the torsion spring biasing the roller tube to move the rolling shutter toward the retracted position, and wherein operation of the quick release mechanism results in the rolling shutter moving toward the retracted position.

Another aspect of the invention is directed to a strap recoiler for use with a roller shutter, the strap recoiler comprising a housing, a take-up roll mounted in the housing, the take-up roll configured for wrapping a strap there-around, a torsion spring biasing the take-up roll in a direction to wrap the strap around the take-up roll, a first mounting bracket connected to the housing configured for pivotally mounting the strap recoiler to a support, and a second mounting bracket connected to the housing configured for releasably mounting the strap recoiler to the support.

Yet another aspect of the invention comprises strap recoiler for use with a roller shutter comprising a housing, take-up roll mounted in the housing, the take-up roll configured for wrapping a strap there-around, a torsion spring biasing the take-up roll in a direction to wrap the strap around the take-up roll, a locking mechanism configured to lock the strap in place, and a quick release mechanism configured to release the locking mechanism upon activation of the quick release mechanism. Various quick release mechanisms are within the scope of this invention.

Additional features of the present invention will become apparent to those skilled in the art upon consideration of the following detailed description of preferred embodiments exemplifying the best mode of carrying out the invention as presently perceived.

DETAILED DESCRIPTION

Directional terms like "above" and "below" and "upper" and "lower" may be used in the description of the roller shutter and tensioner according to the invention. The spatial relationships of the elements are determined by the design and construction of the roller shutter and the portal it protects. Thus, these terms are not intended to limit the invention to a vertical arrangement of elements.

The embodiments disclosed herein illustrated the various aspects of the present invention applied to one particular type of roll-up partition system: rolling protective shutters formed from a plurality of interconnected slats. It will be apparent to those of ordinary skill in the art that the present invention has application in other systems wherein a partition member is coupled to and rolls up onto a support member within a housing, such as roll-up doors, roll-up grills, roll-up gates, fire doors and the like. The application of the present invention to the various types of roll-up partition systems is contemplated by the inventor.

Figure 1:
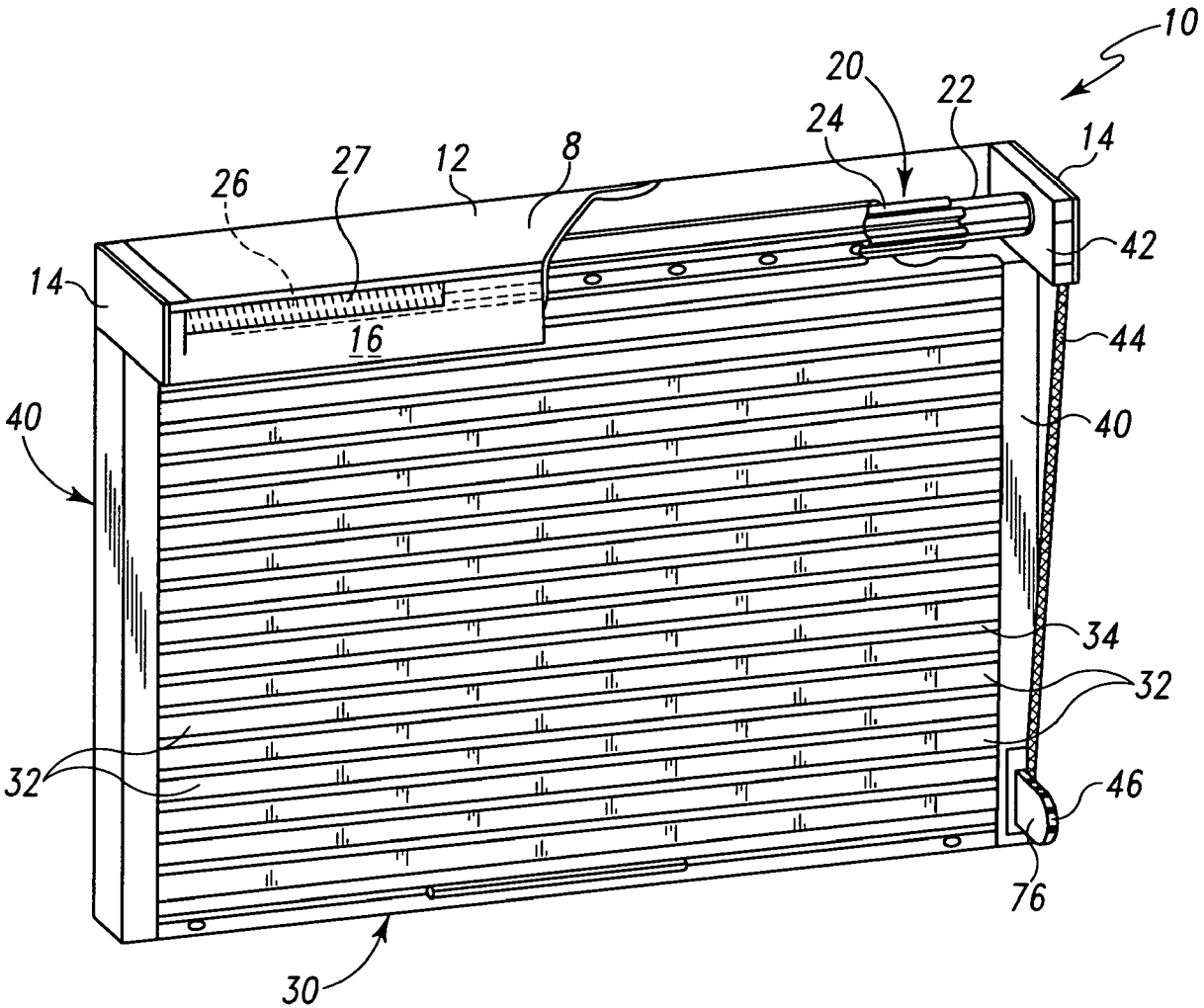
FIG. 1 is a perspective view of a first embodiment of a rolling shutter assembly that can implement the present invention.
Figure 2:
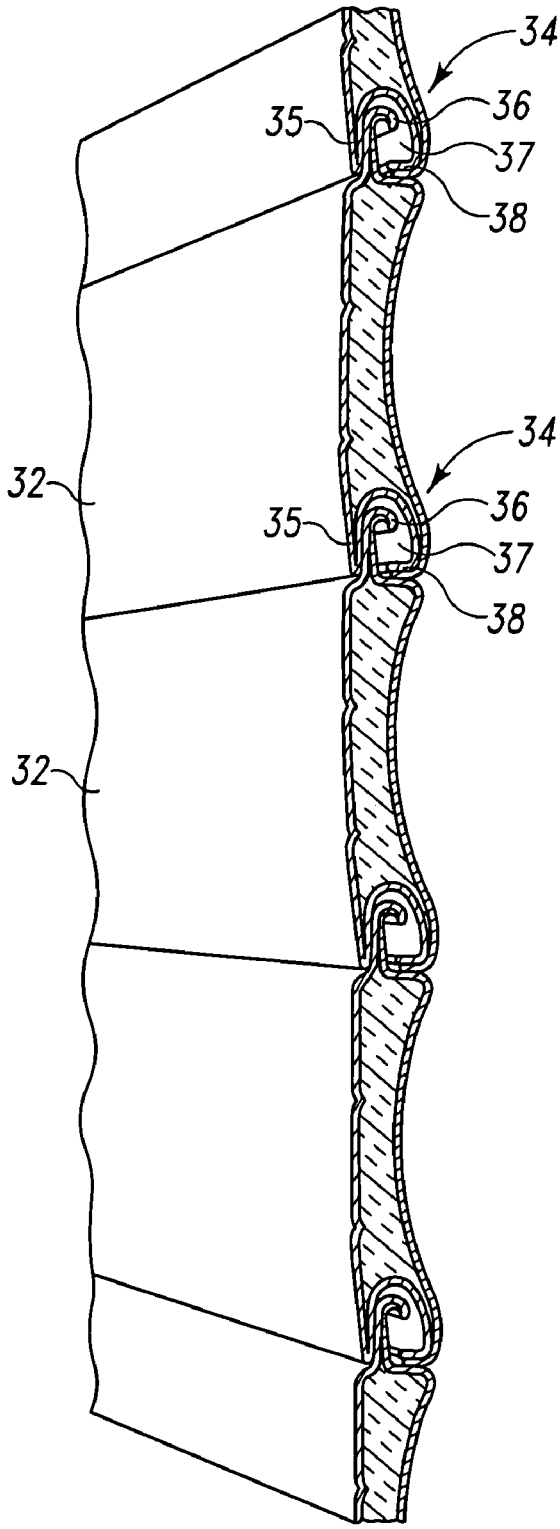
FIG. 2 is a fragmentary perspective view of a portion of the shutter of the shutter assembly of FIG. 1.

One type of a rolling shutter assembly 10 that may implement the present invention is shown in FIGS. 1-2. Referring to FIG. 1, the shutter assembly 10 has a shutter housing 8 that includes a top wall 12, a pair of side walls 14, and a front wall 16. A shutter support member 20 is mounted for rotation within the shutter housing. The support member 20 includes a generally cylindrical central roller tube 22 and a plurality of mounting members 24 fixed to the roller tube 22.

The upper end of a rolling shutter 30 is coupled to the mounting members 24. The shutter 30 is composed of a plurality of individual, elongate slats 32. One example of a configuration of slats 32 is illustrated in FIG. 2. The slats 32, each of which is substantially flat, having two substantially planar side portions, and may be composed of steel, are interconnected by a plurality of hinges 34, each of which joins together a pair of adjacent slats 32. Each of the slats 32 includes an upward projection 35 extending longitudinally along the upper edge of the slat 32 and having a rearwardly and downwardly extending hook 36 at the top. Each of the slats 32 further includes a downward facing U-shaped recess 37 extending longitudinally along the lower edge of the slat 32 and having a forward horizontal projection 38 formed on the rear edge of the recess 37. The hook 36 of a lower slat 32 and the recess 37 and projection 38 of an upper slat 32 interlock to form each hinge 34. Other configurations of slats 32 and interconnecting hinges 34 are well known in the art and are contemplated by the inventor as having use with the present invention. Several such examples of configurations of slats 32 are illustrated in co-pending U.S. patent application Ser. Nos. 10/802,385 and 10/802,257, the disclosures of which are herein incorporated by reference.

Referring back to FIG. 1, a torsion spring assembly 26 is provided to assist roll-up of the shutter. Further details on an exemplary torsion spring assembly are found in U.S. Pat. No. 5,975,185, already incorporated by reference. However, other torsion spring configurations, as are known in the art, are within the scope of this invention. Illustratively, torsion spring 26 is sufficiently strong to fully retract shutter 30 when no braking force is applied. Still referring to FIG. 1, the ends of the slats 32 are disposed within a pair of shutter tracks 40. The shutter assembly 10 has a pulley housing 42 that interconnects the rotatable roller tube 22 to one end of a strap 44 via a conventional pulley (not shown). The other end of the strap 44 is attached to a strap recoiler 46, which is mounted to track 40 via mounting bracket 76. When mounted to protect a window or other opening, the shutter tracks 40 of the shutter assembly 10 are positioned on either side of the opening and the shutter housing is positioned over the top of the opening. Alternatively, in some applications, the side tracks 40 and shutter housing are positioned within the opening.

Figure 3:
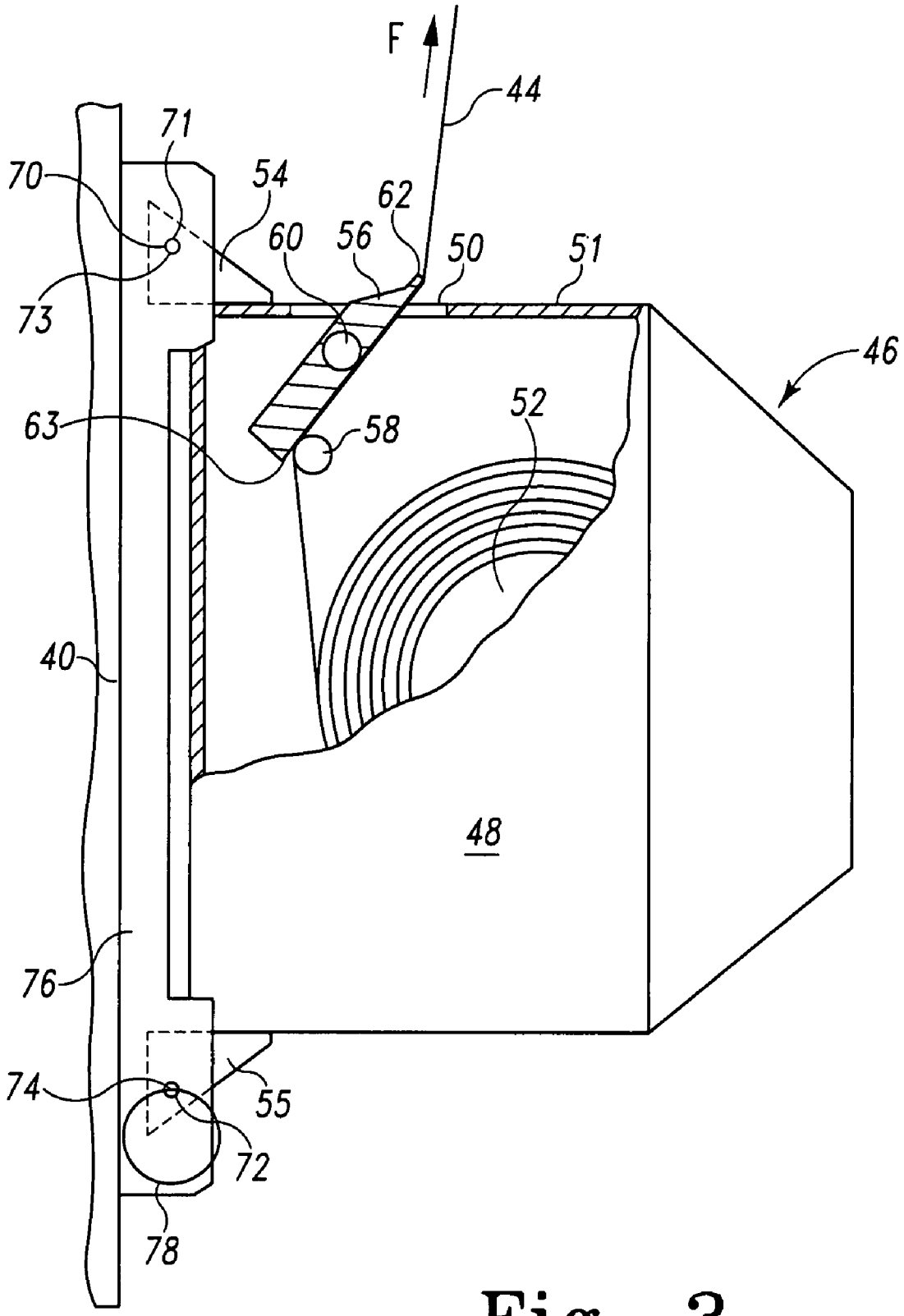
FIG. 3 is a partial cross-sectional side view of the strap recoiler of FIG. 1 in the locked position.
Figure 4:
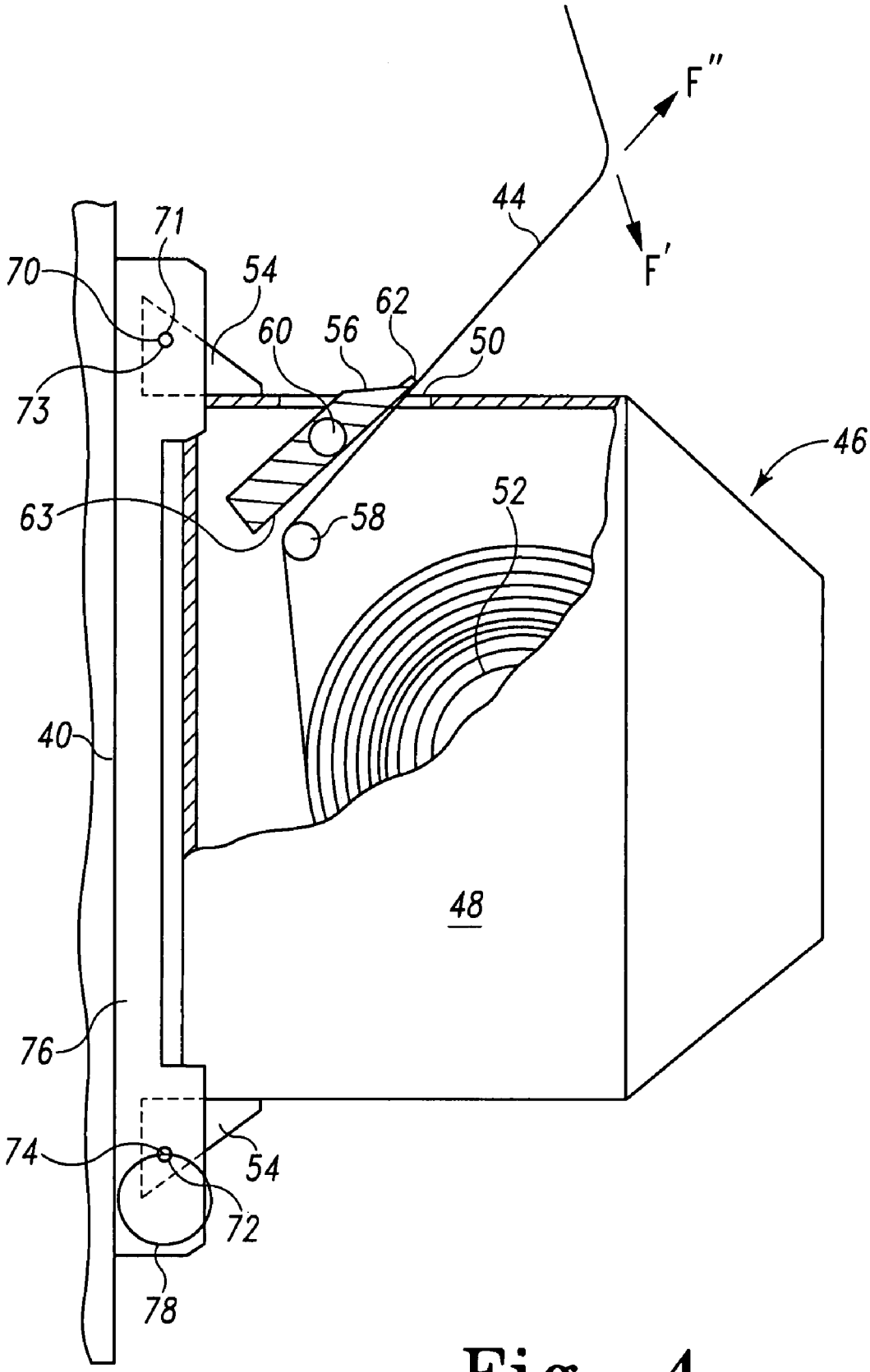
FIG. 4 is a partial cross-sectional side view of the strap recoiler of FIG. 1 in the unlocked position.
Figure 5:
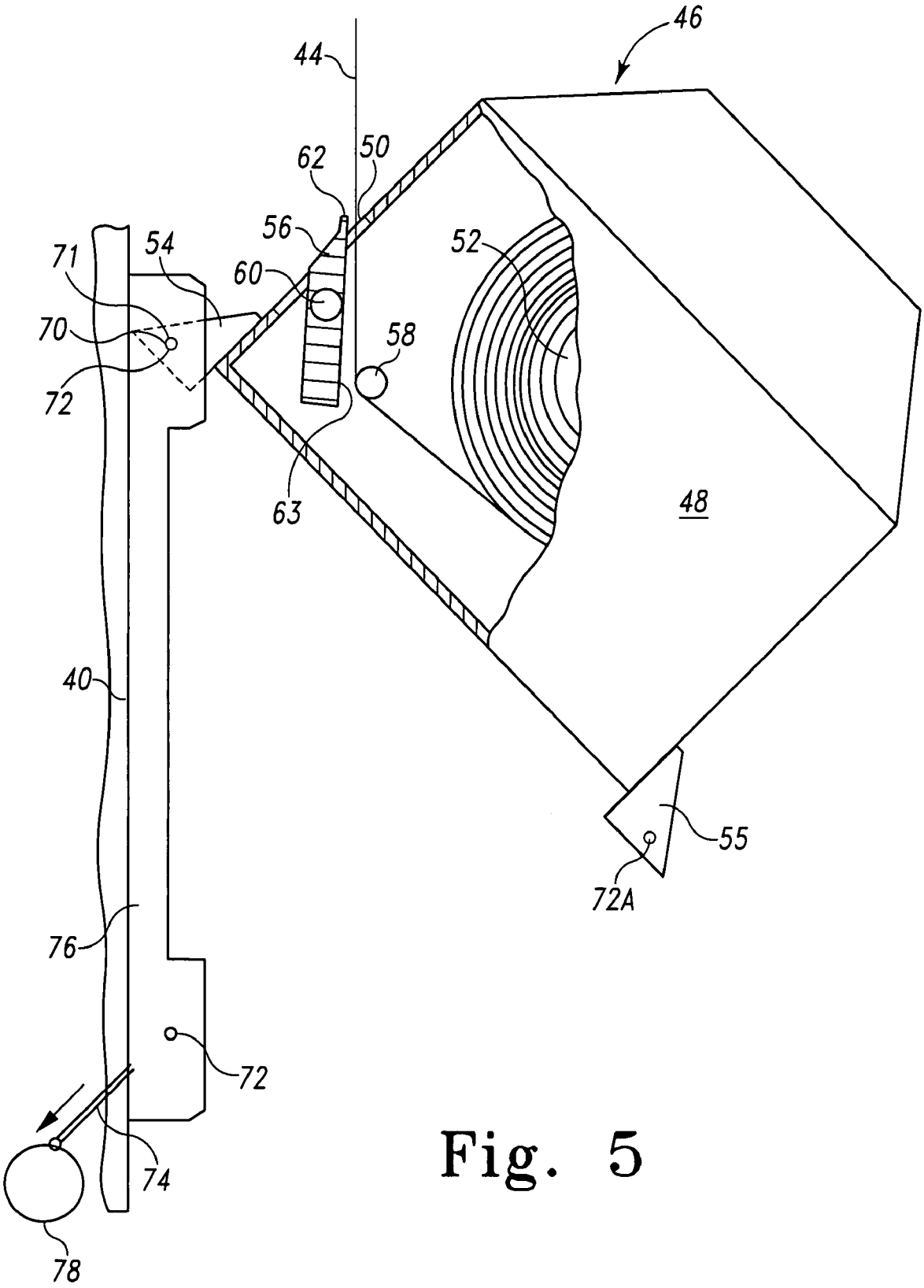
FIG. 5 is a partial cross-sectional side view of the strap recoiler of FIG. 1 in the with the quick release mechanism deployed.

An illustrative strap recoiler 46 is shown in greater detail in FIGS. 3-5. Referring to FIG. 3, the strap 44 enters the housing 48 of the recoiler 46 through an opening 50 in the top 51. The strap 44 is attached to a take-up roll 52 disposed within the housing 48. The take-up roll 52 is rotatably coupled to the housing 48 by a central shaft (not shown) and includes a torsion spring 27 that applies torque that rotates the take-up roll 52 counter-clockwise as shown in FIG. 3, to wrap the strap 44 around the take-up roll 52.

The strap recoiler 46 of FIG. 3 includes a locking mechanism formed by a brake tab 56 and a bearing surface, illustratively bearing pin 58. The brake tab 56 is pivotally mounted to the housing 48 by a pivot pin 60. The brake tab 56 pivots about the pivot pin 60 between a locked position (FIG. 3) wherein the brake tab 56 bears upon the bearing pin 58, and an unlocked position (FIG. 4) wherein the brake tab 56 does not bear upon the bearing pin 58. When the shutter 30 is partially or fully unrolled, the torsion spring tends to rotate the shutter support member 20 in the direction that rolls the shutter 30. This results in a force on the strap 44 in the direction of the shutter housing as indicated by the arrow F. The tension on the strap 44 exerts a force on a tip 62 of the brake tab 56 that rotates an engagement surface 63 at the opposite end of the brake tab 56 into engagement with the bearing pin 58. In this position, the frictional force between the engagement surface 63, the bearing pin 58 and the strap 44 is sufficient to retain the strap 44 and prevent the shutter 30 from rolling or unrolling, depending on the weight of the shutter and relative strengths of the torsion spring in torsion spring assembly 26 and the torsion spring provided in strap recoiler 46.

During normal operation of the shutter assembly 10, the locking mechanism automatically releases the strap 44 when the strap 44 is pulled out to raise or lower the shutter 30, as illustrated in FIG. 4. In an embodiment employing a torsion spring sufficiently strong enough to retract the shutter fully, to unroll the shutter 30 to the deployed position, the strap 44 is pulled outwardly away from the shutter track 40 and the opening and downwardly toward the strap recoiler 46, in the general direction of the arrow F'. As the strap 44 is pulled outwardly and downwardly, the upward force exerted on the tip 62 of the brake tab 56 decreases and the brake tab 56 pivots toward the unlocked position. The strap 44 is released and the force of the torsion spring within the take-up roll 52 winds the excess strap 44 onto the take-up roll 52. At the same time, the strap 44 is unrolled from the roller tube 22, thereby unrolling the shutter 30 from the shutter support member 20. When the strap 44 is released, the tension of the torsion spring 27 rotates the roller tube 22 and pulls the strap 44 tight between the roller tube 22 and the strap recoiler 46, thereby pivoting the brake tab 56 to the locked position of FIG. 3 and securing the strap 44 to prevent the shutter 30 from rolling or unrolling.

To roll the shutter 30 onto the shutter support member 20, the strap 44 is pulled outwardly away from the shutter track 40 and the opening and upwardly away from the strap recoiler 46, in the general direction of the arrow F". As the strap 44 is pulled outwardly and upwardly, the upward force exerted on the tip 62 of the brake tab 56 decreases and the brake tab 56 pivots toward the unlocked position shown in FIG. 4. The strap 44 is released and the tension of the torsion spring 27 rotates the shutter support member 20 and the excess strap 44 winds onto the roller tube 22. At the same time, the strap 44 is unrolled from the take-up roll 52. When the strap 44 is released, the tension in the torsion spring pulls the strap 44 tight between the roller tube 22 and the strap recoiler 46, thereby pivoting the brake tab 56 to the locked position of FIG. 3 and securing the strap 44 to prevent the shutter 30 from rolling or unrolling. It is understood that the direction the strap is moved to effect rolling and unrolling is opposite that of a configuration where the shutter is deployed due to gravity, and the torsion spring (if any) merely assists with retraction.

In certain circumstances, it would be desirable to have a quick release mechanism to release brake tab 56 from bearing pin 58 and permit torsion spring 27 to roll shutter 30, without the need to pull the strap 44 outwardly during the entire rolling process. In various embodiments, the quick release mechanism alters the angle the brake tab 56 and the strap 44, to release the strap 44. In other embodiments, the quick release mechanism moves the brake tab 56 from contact with the bearing pin 58, thereby releasing strap 44.

One such embodiment is illustrated in FIGS. 3-7. As shown in FIGS. 3-5, the housing 48 is mounted to a top mounting bracket 54 and a bottom mounting bracket 55. Optionally, the housing 48 is pivotally connected to brackets 54 and 55, which permits the strap recoiler 46 to rotate from side-to-side if the strap 44 is pulled outwardly at an acute angle with respect to the opening and the wall. A mounting track 76 is also provided. The mounting track 76 may be mounted on shutter track 40, as shown in FIG. 1, or may be mounted on a nearby portion of wall or any other nearby surface. Illustratively, top mounting bracket 54 is pivotally connected to mounting track 76 at pivot point 70. As shown, a pin 73 extends through mounting track 76 at opening 71 and through top mounting bracket 54. However, it is understood that other hinges and devices for pivotally connecting the housing 48 to the mounting track 76 are within the scope of this invention.

As illustrated in FIGS. 3-5, bottom mounting bracket 55 is removably attached to mounting track 76 by way of a removable pin 74 that extends through pin hole 72 in mounting track 76 and pin hole 72A (as shown in FIG. 5) in bottom of mounting bracket 55. Removal of removable pin 74, illustratively by pulling pull ring 78, allows the housing 48 to rotate on pivot point 70 upward, as shown in FIG. 5. Once the housing 48 rotates upward, as shown in FIG. 5, the strap is released from the locked position, and the torsion spring assembly 26 attached to roller tube 22 and the torsion spring 27 in the housing 48 can then work together to roll the strap 44 into the housing 48 and roll the rolling shutter 30 into shutter housing 8. Such a configuration provides for rapid retraction of the shutter with only the removal of a single pin. Conversely, in certain situations where it may be desirous to seal off a portion of the building, the rolling shutter assembly 10 may be provided with weaker torsion springs or without a torsion spring connected to roller tube 22. In this alternative embodiment, removal of the pin 74 would allow rolling shutter 30 to open, thereby closing off the opening in which the rolling shutter 30 is mounted.

It is understood, however, that other means of releasably restraining bottom mounting bracket 55 to mounting track 76 are possible and are within the scope of this invention. Various clips, pins, and other quick release mechanisms may be employed, as are known in the art, such that the quick release mechanism may be easily activated illustratively by pulling a ring or ribbon, or by pressing a button or twisting a handle. It is further understood that while brackets 54 and 55 are shown as separate parts that are connected to housing 48, brackets 54 and 55 may be formed integrally with housing 48. Alternatively, an opening 71A for pivot point 70 may be provided through an upper section of housing 48 and pin hole 72A may be provided in a lower section of housing 48.

Figure 6:
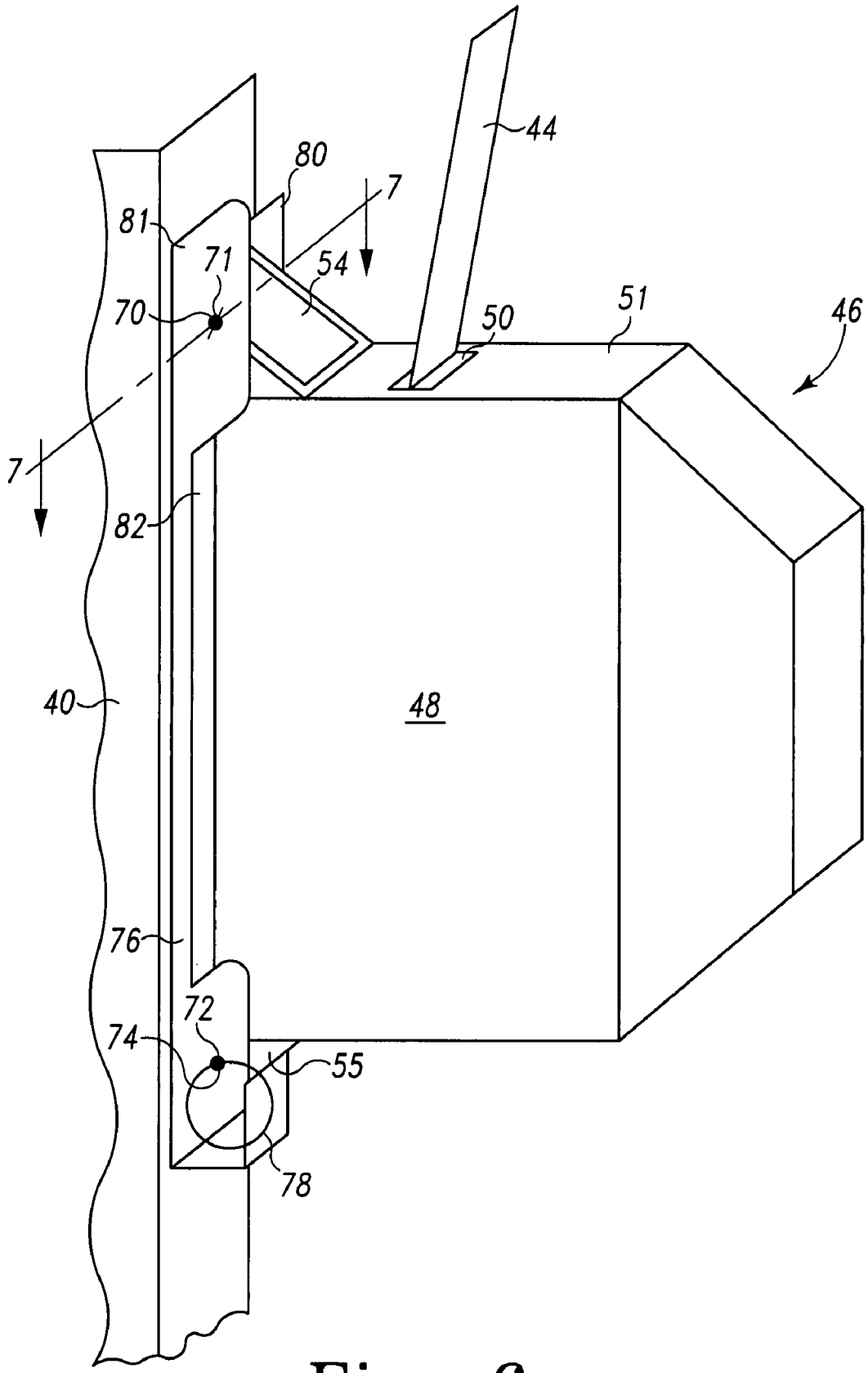
FIG. 6 is an isometric view of a strap recoiler of FIG. 1.
Figure 7:
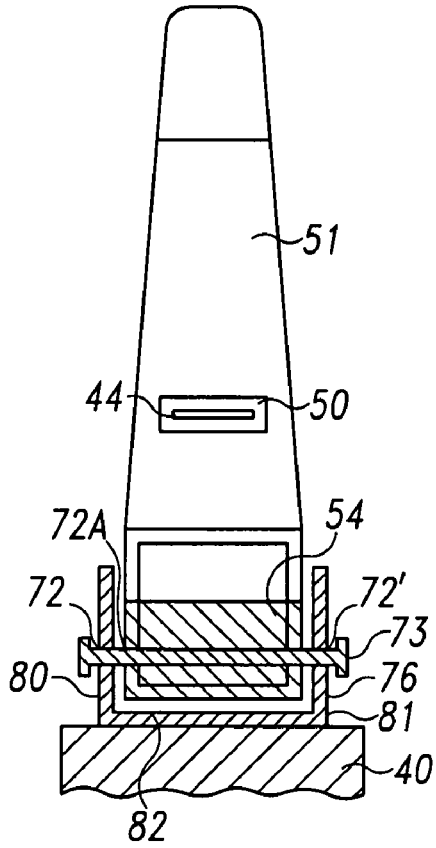
FIG. 7 is a cross-sectional view of the strap recoiler of FIG. 6 along line 7-7.

FIGS. 6 and 7 illustrate more detail of the mounting track 76 and the connection between the mounting track 76 and the strap recoiler 48. As best seen in FIG. 7, mounting track 76 is U-shaped, with a first side 80, a second side 81, and a bottom 82. Top mounting bracket 54 sits within the U-shaped mounting track 76, and is retained by pin 73. Pin 73 extends through hole 72 in the first side 80 of mounting track 76, through hole 72A in top mounting bracket 54, and through hole 72' in the second side 81 of mounting track 76. It is understood that bottom mounting bracket 55 is similarly retained in mounting track 76, except that pull ring 78 allows easy removal of removable pin 74.

Figure 8:
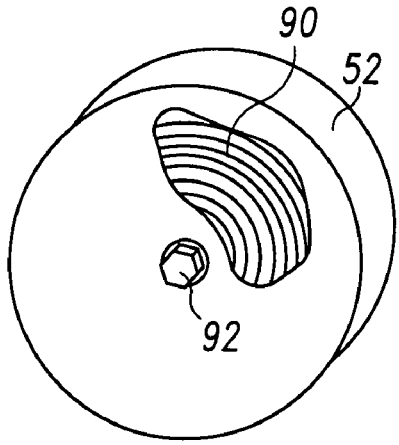
FIG. 8 is an isometric view of a take-up roll for the strap recoiler of FIGS. 3-6.

As previously discussed, the take-up roll 52 in the strap recoiler 46 includes a torsion spring 27 that provides torque to roll up the excess strap 44 when the shutter 30 is opened. FIG. 8 illustrates the take-up roll 52, removed from housing 48. The strap 44 is omitted from the figure for the sake of clarity, but it is understood that the strap is wound around take-up roll 52, and the take-up roll 52 is shown with a portion of the wall removed to expose a torsion spring 90. The take-up roll 52 includes a central shaft 92 that is rotatable with respect to the take-up roll 52. One end of the torsion spring 90 is connected to the take-up roll 52 and the other end is connected to the shaft 92 such that the tension in the torsion spring 90 increases as the strap 44 is unrolled (clockwise rotation of the roll 52) and decreases as the strap 44 is rolled up (counter-clockwise rotation of the roll 52). When the take-up roll 52 is disposed within the housing 48, the shaft 92 is held in a fixed position within the housing 48 and is not permitted to rotate within housing 48. The tension in the torsion spring 90 may be adjusted either by rotating the take-up roll 52 or by varying the amount of the strap 44 that is unrolled from the roll 52.

The quick release mechanism of FIGS. 3-7 includes a pivoting connection between mounting track 76 and strap recoiler 48, wherein the strap recoiler housing pivots to release the locking mechanism. However, other configurations that release the locking mechanism to provide a quick release mechanism are within the scope of the present invention. Illustratively, any mechanism that changes the angle between the brake tab 56 and the strap 44 or otherwise disengages brake tab 56 from bearing pin 58, to release the strap 44, is within the scope of this invention.

Figure 9:
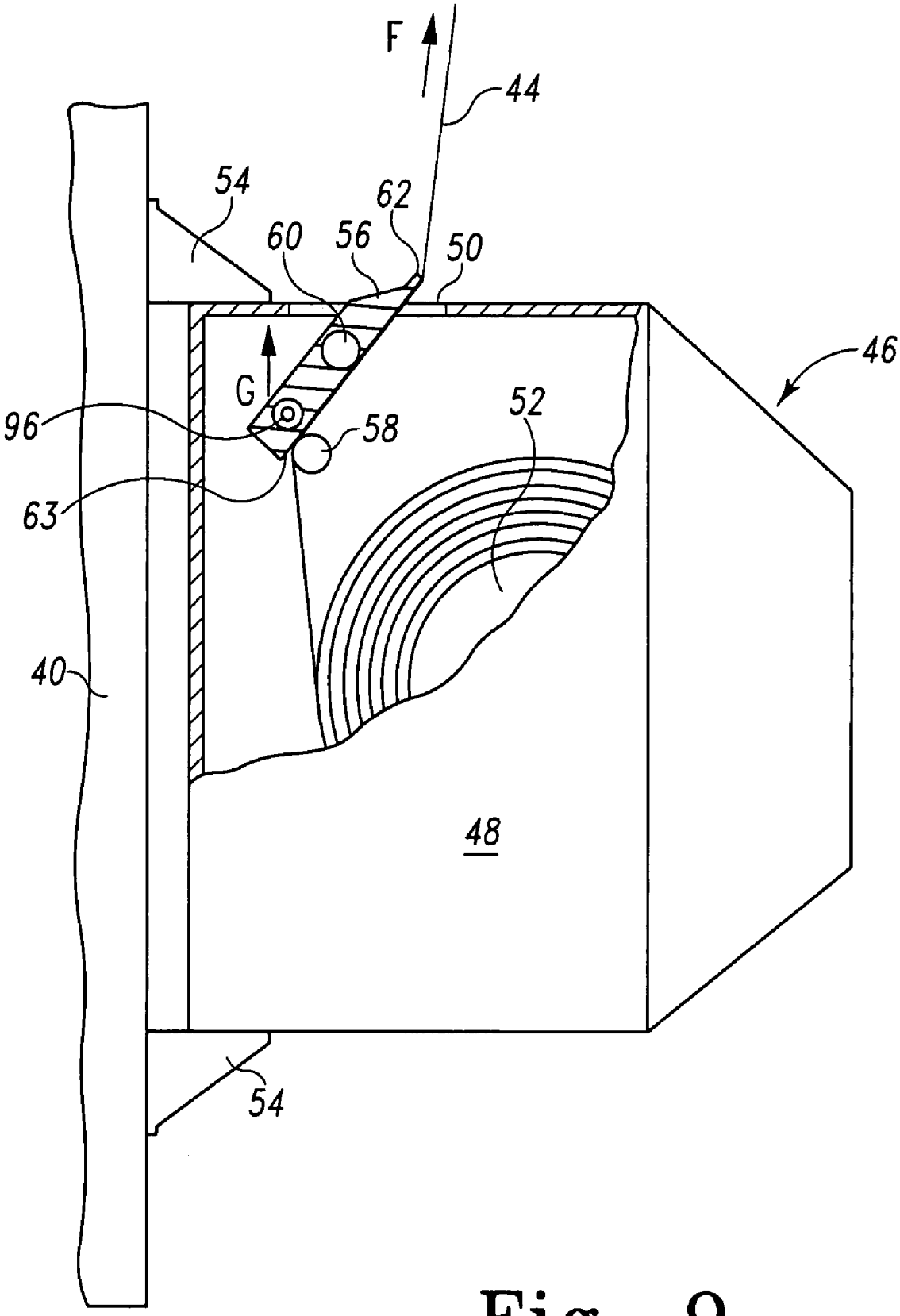
FIG. 9 is a partial cross-sectional side view of another strap recoiler in the locked position.
Figure 10:
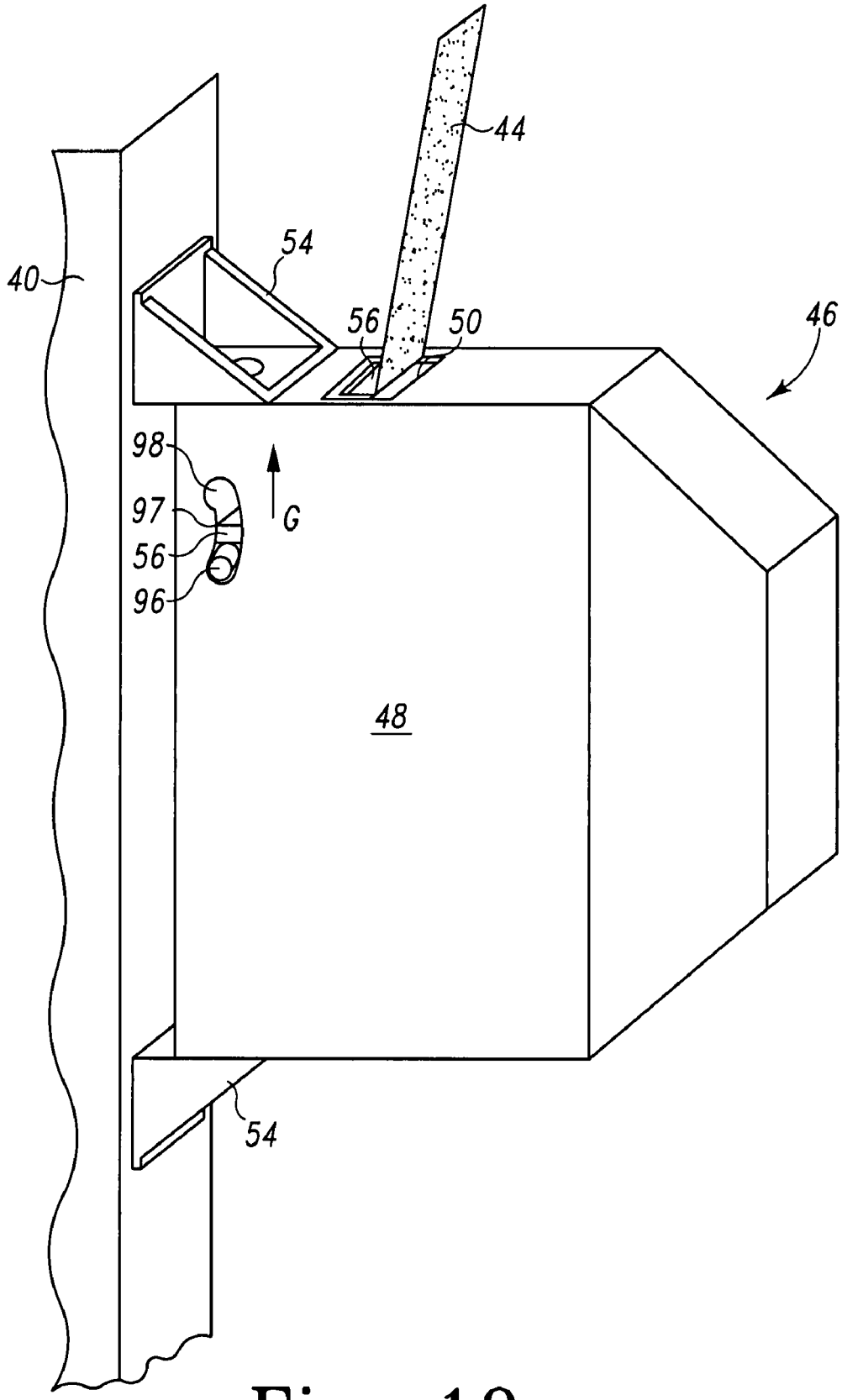
FIG. 10 is an isometric view of a strap recoiler of FIG. 9.
Figure 11:
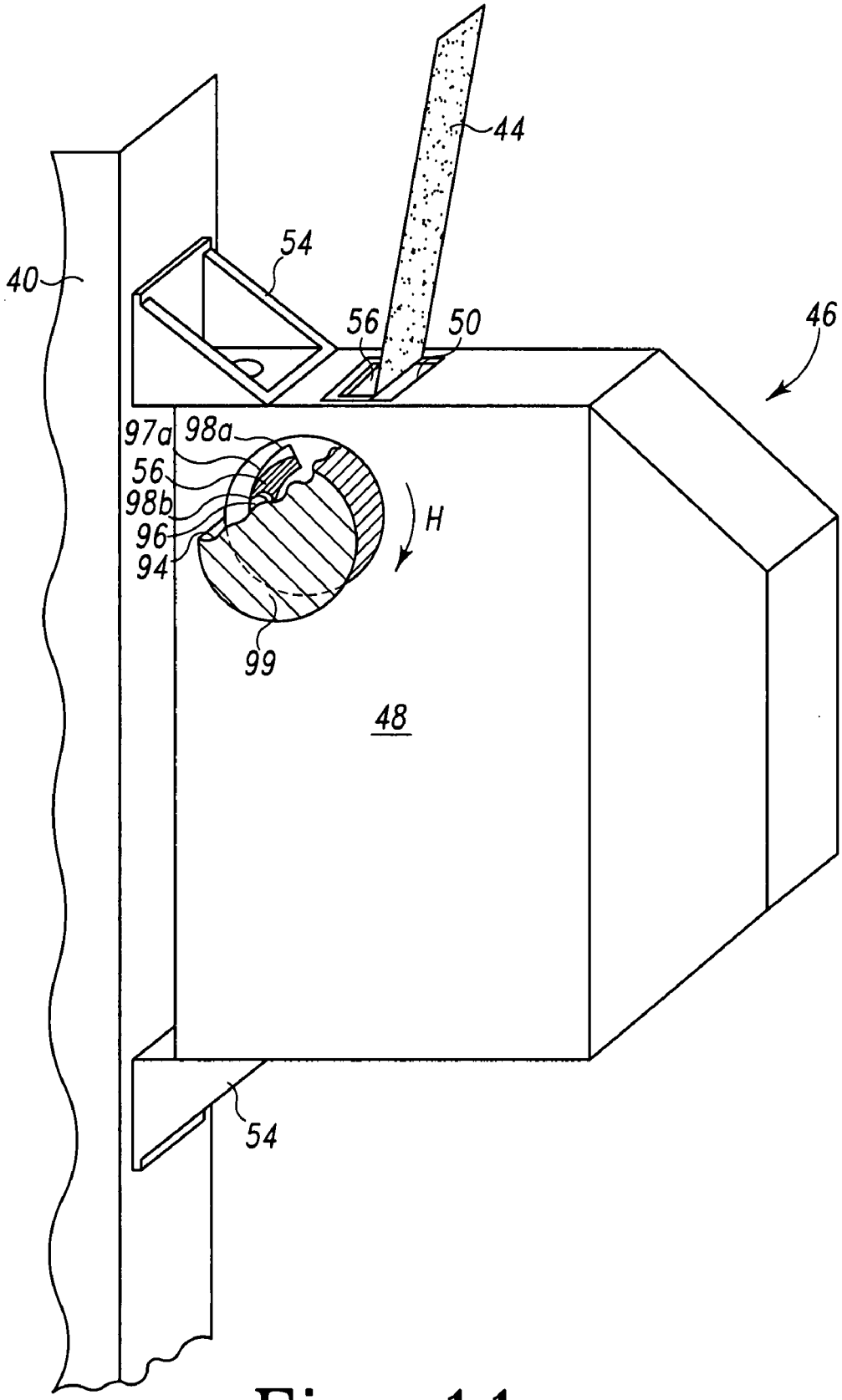
FIG. 11 is an isometric view of an alternative embodiment of a strap recoiler of FIG. 9.

Illustrative embodiments of alternative configurations for a quick release mechanism are shown in FIGS. 9-11. In these embodiments, rather than moving the strap recoiler 46 to change the angle between the brake tab 56 and strap 44, these embodiments change the angle by moving the brake tab 56. In FIG. 9 a lever 96 is provided and is connected to brake tab 56. Lever 96 and brake tab 56 may be formed integrally, or lever 96 may be connected to brake tab 56. Movement of lever 96 in the direction shown by arrow G moves brake tab 56 away from bearing pin 58 and into the unlocked position. As shown in FIG. 10, lever 96 may extend through a slot 97 or other opening in housing 48, to provide a user with easy access to lever 96 to move lever 96 in the direction shown by arrow G. A notch 98, provided in slot 97 allows the user to secure lever 96 in position, thereby securing brake tab 56 in the unlocked position. Other mechanisms for retaining lever 96 in the locked or unlocked position are possible.

In FIG. 10, lever 96 extends through curved slot 97*a* and is attached to a knob 99. Rotation of knob 99 in the direction shown by arrow H moves lever 96 in curved slot 97*a* and moves brake tab 56 to the unlocked position. A notch 98*a* may be provided to secure lever 96 in position, thereby securing brake tab 56 in the unlocked position. Another notch 98*b* at the opposite end of slot 97*a* may be provided to secure lever 96 in position such that brake tab 56 is secured in the locked position. Other configurations for securing knob 99 or lever 96 are within the scope of this invention.

Additionally, it is understood that lever 96 could be placed near tip 62 of brake tab 56, with movement of lever 96 in a direction opposite to that shown by G in FIG. 9, to move brake tab 56 to the unlocked position. Alternatively, a magnet may be placed on the outside of housing 48 to move brake tab 56. In yet another alternative embodiment, engagement surface 63 may be moved to change the angle between brake tab 56 and strap 44. In yet another embodiment, the quick release mechanism is a lever, magnet, or other device that moves bearing pin 58 away from brake tab 56 to release strap 44. Other configurations are possible that move the brake tab 56 to an unlocked position to provide a quick release mechanism.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

The invention claimed is:

1. A roll-up partition comprising:

a) a shutter assembly comprising:

i) a shutter assembly housing adapted to be mounted to a wall above or beside a portal, ii) a roller tube rotatably mounted in the shutter assembly housing, and iii) a rolling shutter connected to the roller tube and configured to move between a retracted position in which the rolling shutter is wrapped around the roller tube and an open position in which the rolling shutter is deployed within the portal, b) a flexible strap having a proximal end and a distal end, the proximal end connected to the roller tube, and c) a tensioner positioned external to the shutter assembly housing and connected to the distal end of the flexible strap, the tensioner comprising a locking mechanism configured to lock the flexible strap in place when in a locked position and to allow movement of the flexible strap when in an unlocked position and a quick release mechanism configured to interact with the locking mechanism to release the locking mechanism from the locked position to the unlocked position upon activation of the quick release mechanism to allow the rolling shutter to change positions.

2. The roll-up partition of claim 1 wherein the locking mechanism is a pivotable brake tab that bears against the flexible strap when the pivotable brake tab is in a first angle with respect to the flexible strap, and activation of the quick release mechanism moves the pivotable brake tab to a second angle with respect to the flexible strap.

3. The roll-up partition of claim 1 wherein the locking mechanism comprises a brake tab and a bearing surface to lock the flexible strap therebetween, and the quick release mechanism moves either the brake tab or the bearing surface to provide a space therebetween and release the flexible strap.

4. The roll-up partition of claim 1 further comprising a torsion spring connected to the roller tube, the torsion spring biasing the roller tube to move the rolling shutter toward the retracted position.

5. The roll-up partition of claim 4 wherein operation of the quick release mechanism results in the rolling shutter moving to the retracted position.

6. The roll-up partition of claim 1 wherein the tensioner is a strap recoiler comprising a take-up roll connected to the distal end of the flexible strap and a torsion spring that applies torque to the take-up roll to bias the flexible strap away from the shutter assembly housing.

7. The roll-up partition of claim 1 wherein the quick release mechanism comprises a knob rotatably mounted on an exterior surface of the tensioner and operably connected to the locking mechanism such that rotation of the knob releases the locking mechanism.

8. The roll-up partition of claim 1 wherein the quick release mechanism comprises a lever connected to the locking mechanism.

9. The roll-up partition of claim 8 wherein the locking mechanism comprises a brake tab and a bearing pin, the lever is connected to the brake tab, and operation of the lever moves the brake tab from the bearing pin.

10. The roll-up partition of claim 8 wherein the lever extends through an opening in an exterior surface of the tensioner.

11. The roll-up partition of claim 1 the rolling shutter is disposed within a pair of shutter tracks mounted on either side of the portal.

12. The roll-up partition of claim 1 wherein the support is one of the shutter tracks.

13. The roll-up partition of claim 1 wherein the portal is a window.

14. A strap recoiler for use with a roller shutter comprising a housing, a take-up roll mounted in the housing, the take-up roll configured for wrapping a strap there-around, a torsion spring biasing the take-up roll in a direction to wrap the strap around the take-up roll, a locking mechanism configured to lock the strap in place when in a locked position and to allow movement of the strap when in an unlocked position, and a quick release mechanism configured to release the locking mechanism from the locked position to the unlocked position upon activation of the quick release mechanism.

15. The strap recoiler of claim 14 wherein the locking mechanism is a pivotable brake tab that bears against the strap when the brake tab is in a first angle with respect to the strap, and activation of the quick release mechanism moves the brake tab to a second angle with respect to the strap.

16. The strap recoiler of claim 14 wherein the locking mechanism comprises a brake tab and a bearing surface to lock the strap therebetween, and the quick release mechanism moves either the brake tab or the bearing surface to provide a space therebetween and release the strap.

17. The strap recoiler of claim 14 wherein the quick release mechanism comprises a lever connected to the locking mechanism, the lever extending through an opening in the housing.

18. The strap recoiler of claim 17 wherein the quick release mechanism comprises a knob rotatably mounted on an exterior surface of the housing and operably connected to the locking mechanism such that rotation of the knob releases the locking mechanism.

19. A method of exiting an enclosed space bounded by at least one wall having a portal protected by a deployed roller shutter, the deployed roller shutter comprising:

a shutter assembly comprising:

a shutter assembly housing adapted to be mounted to a wall above or beside a portal, a roller tube rotatably mounted in the shutter assembly housing, a rolling shutter connected to the roller tube and configured to move between a retracted position in which the rolling shutter is wrapped around the roller tube and an open position in which the rolling shutter is deployed within the portal, and a torsion spring connected to the roller tube, the torsion spring biasing the roller tube to move the rolling shutter toward the retracted position, a flexible strap having a proximal end and a distal end, the proximal end connected to the roller tube, a tensioner external to the shutter assembly housing, the tensioner connected to the distal end of the flexible strap, the tensioner comprising a quick release mechanism and a locking mechanism configured to lock the flexible strap in place, wherein operation of the quick release mechanism the quick release mechanism cooperates with the locking mechanism to release the lock of the locking mechanism on the flexible strap and allow the torsion spring to bias the rolling shutter toward the retracted position, the method comprising the steps of:

a) operating the quick release mechanism, b) waiting for the shutter to retract, and c) exiting the enclosed space through the portal.

20. The method of claim 19 wherein the locking mechanism is a pivotable brake tab that bears against the flexible strap when the brake tab is in a first angle with respect to the flexible strap, and activation of the quick release mechanism moves the brake tab to a second angle with respect to the flexible strap.

21. The method of claim 20 wherein the locking mechanism comprises a brake tab and a bearing surface to lock the flexible strap therebetween, and the quick release mechanism moves either the brake tab or the bearing surface to provide a space therebetween and release the flexible strap.

22. The method of claim 19 wherein the operating step comprises moving a lever that is operationally connected to the locking mechanism.

23. The method of claim 19 wherein the quick release mechanism comprises a knob rotatably mounted on an exterior surface of the tensioner and operably connected to the locking mechanism and the operating step comprises rotating the knob.

24. The method of claim 19 wherein the quick release mechanism comprises a lever attached to the locking mechanism, and the operating step comprises moving the lever.

* * * * *